United States Patent [19]

Kohli

[11] 4,419,792

[45] Dec. 13, 1983

[54] REVERSIBLE BELT AND BUCKLE MECHANISM

[75] Inventor: Jerry L. Kohli, Feeding Hills, Mass.

[73] Assignee: Buxton, Inc., Agawam, Mass.

[21] Appl. No.: 332,012

[22] Filed: Dec. 18, 1981

[51] Int. Cl.[3] ..... A44B 11/00

[52] U.S. Cl. ..... 24/170; 24/191; 24/307

[58] Field of Search ..... 24/163 R, 165, 168, 24/170, 171, 177, 178 R, 182, 191, 163 FC, 307, 311

[56] References Cited

U.S. PATENT DOCUMENTS

| | | | |
|---|---|---|---|
| 658,124 | 9/1900 | Semple | 24/165 |
| 1,763,100 | 6/1930 | Mendosa | 24/163 R |
| 1,775,137 | 9/1930 | Ostrower | 24/182 |
| 2,186,819 | 1/1940 | Buchsbaum | 24/178 R |
| 2,197,665 | 4/1940 | Kerngood | 24/178 R |
| 2,630,612 | 3/1953 | Stark | 24/178 R |
| 3,369,278 | 2/1968 | Erteszek | 24/163 R |
| 3,384,936 | 5/1968 | Sokoloff | 24/191 |
| 3,855,637 | 12/1974 | Luger | 24/163 R |
| 4,281,440 | 8/1981 | Britz | 24/163 FC |

*Primary Examiner*—Gene Mancene
*Assistant Examiner*—Kris Schulze
*Attorney, Agent, or Firm*—John J. Dempsey

[57] ABSTRACT

A reversible belt and buckle which has a pivotable buckle frame portion finished on opposite sides so that it can be reversed to selectively display its outer and inner surfaces. A keeper member includes a locking lever with a latch to grip the inner end of a belt strap in a fixed position therein and a coupling portion which releasably retains the buckle frame in pivotable relation on the keeper.

8 Claims, 6 Drawing Figures

Fig. 4.
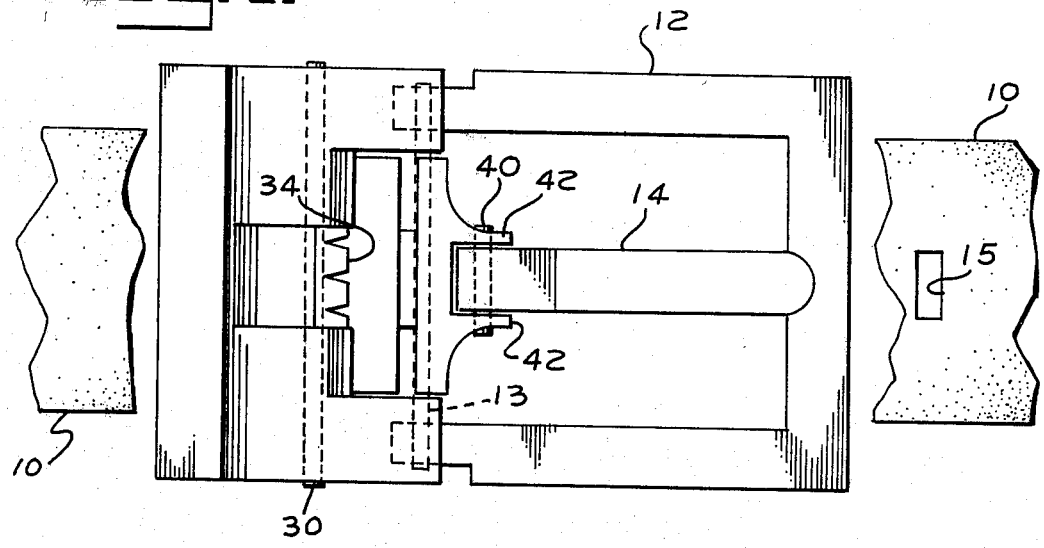
Fig. 5.
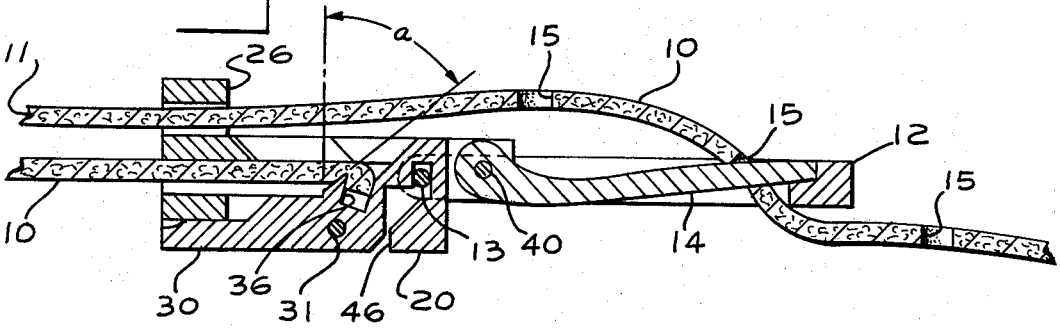
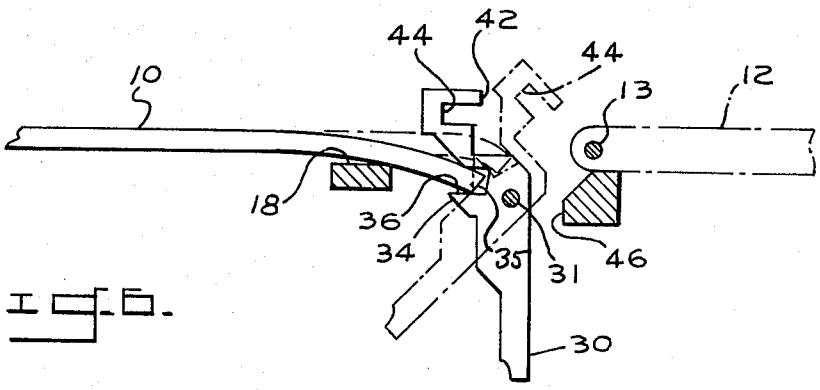
Fig. 6.

REVERSIBLE BELT AND BUCKLE MECHANISM

BACKGROUND OF THE INVENTION

The present invention relates to a belt and buckle keeper mechanism used to interconnect the belt and buckle and permit reversal of both the belt and the buckle frame so that opposite sides of each may be independently displayed as desired.

For many years, reversible belts have been available and various mechanisms have been provided whereby the belt may be reversed to display either side, which may be of different colors and/or designs. Prior art U.S. Pat. Nos. showing various types of belt reversing mechanisms include: 2,186,810; 2,197,665; 2,630,612; 3,369,278 and 3,855,637.

While the above cited patents show different types of mechanisms which allow the belt, per se, to be reversed relative to the buckle, no suitable mechanism is disclosed which provides for inside out reversal of the loop or frame portion of the buckle itself relative to the belt. With this type of mechanism, the appearance of the buckle can be selectively changed without reversing the belt.

It is the principal object of the invention to provide a belt buckle of improved construction which enables independent reversal of the buckle relative to the belt.

It is a further object of this invention to provide a belt buckle construction of the above type which is of simple and economical construction.

Another object of this invention is to provide a belt buckle construction of the above type which is easy to use, but effective and reliable in its operation.

DESCRIPTION OF THE DRAWINGS

The above and other objects and advantages of this invention will be more apparent from the following drawings in which:

FIG. 4 is a top plan view of the buckle;

FIG. 5 is a side elevated view of the buckle shown in combination with a belt disposed in closed condition, and FIG. 6 is a partial side elevated view of a portion of the buckle to illustrate its locking feature.

Figure 1:
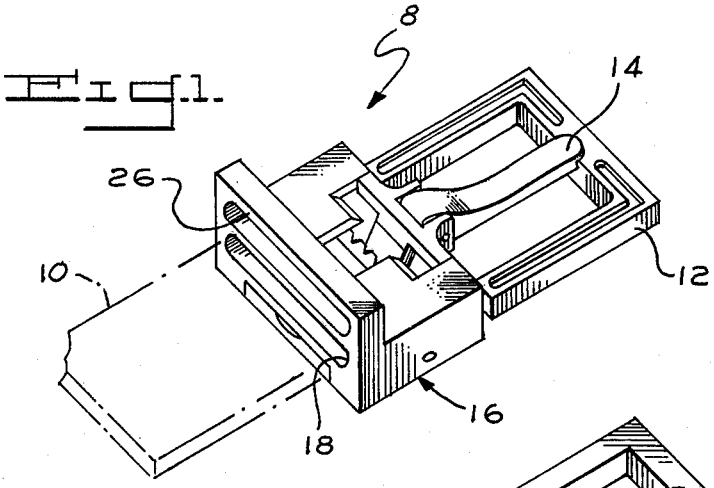
FIG. 1 is a perspective view of a belt buckle shown from top embodying this invention.

Referring to detail to the drawings, a buckle mechanism embodying this invention is shown generally at 8 in FIG. 1. A belt 10 is shown fastened at its inner end to the buckle 8. The buckle includes a loop or frame portion 12 with a pivotable tongue 14 adapted to engage in a conventional manner longitudinally spaced holes 15 (FIG. 5), provided along the center line of the outer end portion of the belt. The frame 12 includes a pivot means shown as a transverse pin 13 carried at its inner end for pivotable mounting of the frame. The frame, tongue 14 and belt 10 are all maintained in assembled relation by means of a keeper 16. The frame an tongue are each pivotably mounted and independently at one end of the keeper, while the belt is latched into the opposite end as well hereafter be more fully described.

As shown, the keeper 16 is generally in the form of a block of metal or synthetic plastic which may be fabricated by machining, casting, or injection molding techniques. The keeper is of unitary construction and is generally rectangular in cross section with a central bore of passageway 18 extending from end-to-end therethrough. The keeper 16 includes a top wall 20, an apertured bottom wall 22 and sidewalls 24.

Figure 2:
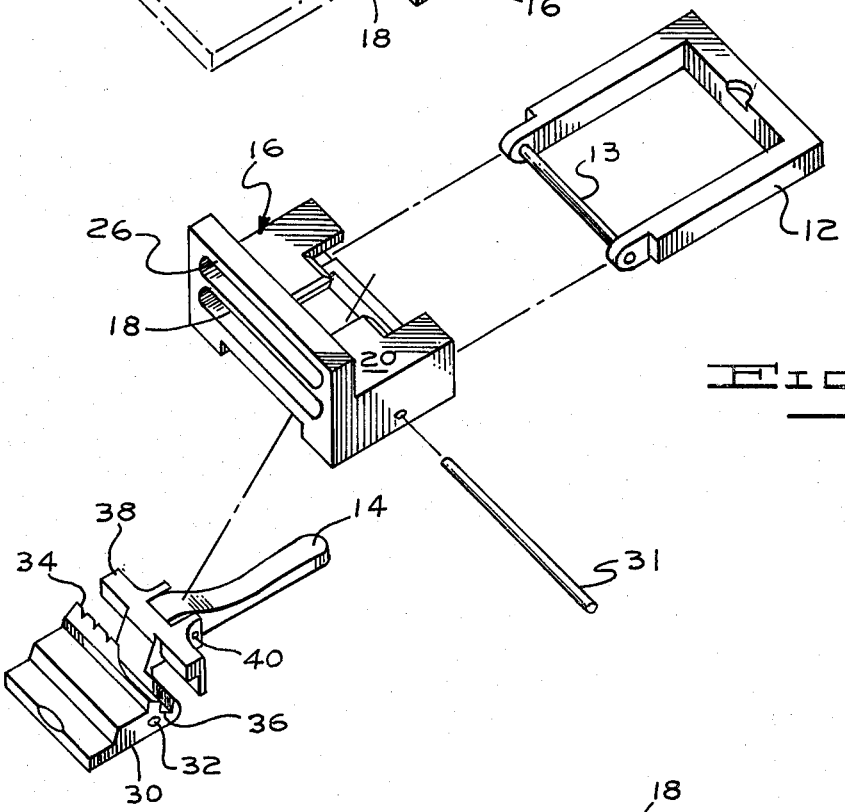
FIG. 2 is an exploded view of the belt buckle shown in FIG. 1.
Figure 3:
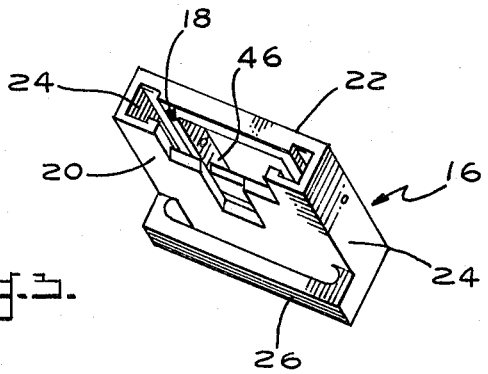
FIG. 3 is a perspective view of a portion of the buckle.

Disposed adjacent its inner end and bridging the upper surface, the keeper includes a belt-end retainer loop 26 for receiving and holding the free outer end of the belt 10 neatly against inner end portion of the belt 10, as shown in FIG. 5. The keeper 16 includes a latch lever 30 which is pivotably mounted on a transversely extending pivot pin 31 (FIG. 2). The pin extends through aligned holes in the sidewalls 24 of the keeper and a bore 32 (FIG. 2) through the latch member located adjacent the inner end thereof outwardly of a rib portion 34 of the latch member. In the embodiment shown, the outer edge of the rib is toothed or serrated for enhanced gripping actions. Forward of the toothed rib 34 the latch member further includes a U-shaped channel 36 to receive the inner terminal end 35 of the belt 10 when it is being fastened to the buckle as illustrated in FIG. 6. Extending upwardly and outwardly from the central portion of the channel is a transverse tongue holder bar member 38 (FIG. 2). The tongue is pivotably mounted on a pin 40 extending between a pair of laterally spaced arms 42 (FIG. 4) on the forward face of the bar 38. As best seen in FIGS. 5 and 6, the underside of the bar 38 comprises a downwardly facing channel 44 adapted to receive and retain the pivot pin 13 of frame 12 between the channel and bottom wall 22 of the keeper 16 (FIG. 5) thereby coupling the frame to the outer end of the keeper.

The bottom wall 22 of the keeper is formed with a rectangular opening 46, which is to accomodate the latch member 30 in a generally flush arrangement as best illustrated in FIG. 5.

The buckle mechanism embodying the invention thus includes, in addition to the belt itself, a frame 12 and keeper 16. The keeper includes, as a subassembly, a pivotable latching lever 30 for releasably clamping the belt and coupling pivotable frame thereto.

To assemble the components of the reversible buckle mechanism, reference is made to FIG. 6. As will be seen, the terminal end of the belt 10 is inserted into the central passageway 18 with the latch lever 30 swung to its open position generally perpendicular to the keeper 16. The U-shaped channel 36 of the latch member in this position faces forward and is adapted to receive the end of the belt. At the same time, the inner end of the frame 12 is fitted into the opposite end of the bore 18 with its pivot pin 13 positioned as shown in FIG. 6. The lever 30 may even be swung upwardly toward its horizontal position (FIG. 5), and in so doing, two locking actions occur simultaneously. The toothed rib 34 will tightly grip the belt 10 as it swings over the vertical or top dead center position relative to the pivot pin 31 of the latch lever. The downwardly facing channel 44 will couple the pivot pin 13 of the frame 12 to the keeper. In its locked position, the latch lever is best illustrated in FIG. 5 wherein its outer end abuts the recessed portion of bottom wall 22.

The toothed rib 34, when the latch lever is being swung to its closed position, will first compress the belt material to a maximum extent when the rib is perpendicular to the belt or in its "top dead center" position. Upon final closing of the lever 30, the rib 34 extends at an acute angle a relative to the perpendicular. There is thus a horizontal component of holding force exerted by the toothed rib 34, which component is along the plane of the belt. This geometric arrangement serves to lock securely the lever in its fully closed position. Whereby, in order to unlatch the lever 30, it is necessary to pivot its outer end over a substantial distance, through the angle a, and with increasing force to compress the belt material to the maximum extent at the perpendicular position of the rib 34. This configuration thereby prevents accidental or unintentional unlocking of lever 30, such as by a small opening movement.

Having thus disclosed the invention, what I claim is:

1. Belt buckle for use with a separable belt comprising a belt-receiving keeper having a slot opening at one end of the keeper to receive an end portion of said belt, a discrete frame releasably connectable in hinged relation onto said keeper at the end opposite said one end, said keeper including a recess in the underside thereof opening downwardly and communicating with said slot, a pivotable latch lever mounted on said keeper and including a latch-rib portion for releasably engaging said end portion of said belt when disposed said slot for fastening the belt and buckle together, said lever also including a frame coupling portion for retaining said frame in assembled relation on said keeper, said latch lever having an open position in which the lever extends outwardly of the keeper for releasing said belt and a closed position for fastening the belt within said slot and coupling the frame onto said keeper when the latch lever is disposed within the recess on the underside of said keeper.

2. Belt buckle as set forth in claim 1, in which said frame includes a transverse pivot pin at its inner end by which said frame is pivotably coupled to said keeper.

3. Belt buckle as set forth in claim 2, in which a belt engaging tongue extends across said frame from its inner to outer end and is pivotably relative to said frame and said keeper.

4. Belt buckle as set forth in claim 3, in which the inner end of said tongue is pivotably carried on said latch lever.

5. Belt buckle as set forth in claim 4, in which said latch lever is dimensioned to fit within said recess for generally flush mounting with the undersurface of the keeper of said buckle.

6. Belt buckle as set forth in claim 5, in which said keeper includes an integral belt receiving loop disposed across the outer surface of the keeper for receiving the outer end portion of the belt.

7. Reversible belt buckle for use with a separable belt comprising a belt receiving keeper, a discrete frame including a transverse pivot pin for hingedly coupling the frame to said keeper, and a latch lever pivotably mounted on said keeper, said lever being pivotable between a fully open position extending outwardly of said keeper and a closed position parallel to the undersurface of said keeper, said lever including a belt engaging rib extending from its upper surface and a downwardly facing channel for receiving the pivot pin of the frame and coupling the same to said keeper, said lever being pivotable about an axis and including a belt-hole engaging tongue pivotably carried by said lever whereby the lever is movable to engage simultaneously the underside of said belt by the belt engaging rib and to couple the frame to said keeper and to position said tongue in pivotable relation across said frame.

8. Reversible belt buckle as set forth in claim 7 in which said latch rib is disposed relative to the pivot axis of the latch lever so that the rib is perpendicular to the belt when the lever is open, and when the lever is closed, said rib extends at an oblique angle relative to said perpendicular orientation.

* * * * *